US008042799B2

(12) United States Patent
Clark

(10) Patent No.: US 8,042,799 B2
(45) Date of Patent: Oct. 25, 2011

(54) VACUUM LEVEL SWITCH FOR A VACUUM CORRUGATED FEEDER

(75) Inventor: Robert A. Clark, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/559,934

(22) Filed: Sep. 15, 2009

(65) Prior Publication Data

US 2011/0062652 A1 Mar. 17, 2011

(51) Int. Cl.
*B65H 3/08* (2006.01)
*B65H 3/12* (2006.01)

(52) U.S. Cl. ..... 271/108; 271/96

(58) Field of Classification Search ..... 271/108, 271/90, 94, 96, 276
See application file for complete search history.

(56) References Cited

U.S. PATENT DOCUMENTS 4,662,622 A * 5/1987 Wimmer et al. ..... 271/96
5,088,713 A * 2/1992 Hayashi ..... 271/3.03
5,102,114 A * 4/1992 Suda ..... 271/18
6,254,081 B1 * 7/2001 Rasmussen et al. ..... 271/96
6,279,896 B1 * 8/2001 Linder et al. ..... 271/98
6,290,225 B1 * 9/2001 Linder et al. ..... 271/155
6,412,769 B1 * 7/2002 Goda et al. ..... 271/94
7,028,617 B2 * 4/2006 Shibabuki et al. ..... 101/477
7,131,646 B2 * 11/2006 Guddanti et al. ..... 271/292
7,258,336 B2 8/2007 Moore et al.
7,461,839 B2 * 12/2008 Ikeda ..... 271/108
2007/0170638 A1 * 7/2007 Ikeda ..... 271/98

* cited by examiner

*Primary Examiner* — Kaitlin Joerger
*Assistant Examiner* — Patrick Cicchino
(74) *Attorney, Agent, or Firm* — Ronald E. Prass, Jr.; Prass LLP

(57) ABSTRACT

This invention provides a simple vacuum level switch to be used inside the feedhead's vacuum plenum to detect when the vacuum level exceeds a predefined threshold. This switch is composed of an opening in the plenum that is covered by a cap which is in turn spring-loaded against the opening. The mechanical properties of the spring are such that the cap is pushed away from the opening by ambient air pressure at the point when the vacuum threshold has been reached during sheet acquisition. A Hall Effect or optical sensor is used to detect this motion and the corresponding signal is sent to the feeder controller. This enables more intelligent control of the feeder while also providing an inexpensive method for tracking sheet acquisition times.

13 Claims, 3 Drawing Sheets

VACUUM LEVEL SWITCH FOR A VACUUM CORRUGATED FEEDER

This invention relates to a marking system and, more specifically, to a paper feeding structure and system.

BACKGROUND

While the present invention can be used in any paper feeding marking system, it will be described herein for clarity as used in electrostatic marking systems such as electrophotography or xerography.

By way of background, in marking systems such as xerography or other electrostatographic processes, a uniform electrostatic charge is placed upon a photoreceptor belt or drum surface. The charged surface is then exposed to a light image of an original to selectively dissipate the charge to form a latent electrostatic image of the original. The latent image is developed by depositing finely divided and charged particles of toner upon the belt or drum photoreceptor surface. The toner may be in dry powder form or suspended in a liquid carrier. The charged toner, being electrostatically attached to the latent electrostatic image areas, creates a visible replica of the original. The developed image is then usually transferred from the photoreceptor surface to an intermediate transfer belt or to a final support material such as a paper sheet. When the paper is fed to the system from a paper stack of a feeder mechanism, some papers could be off the home position by many mm and these fed paper sheets need to be rapidly and properly fed.

In high speed commercial printing machines, precise timing and positioning of fed paper is critical to producing consistently high quality images. Generally, in the sheet feeding assembly, an apparatus blows gas or air against a sheet stack on a sheet stacking unit; then the sheet feeding apparatus suctions an uppermost one of the sheets to a conveyance belt via take-away rollers (TAR) to be carried through the marking system for contact with the latent image on the photoreceptor. The sheet feeding apparatus is precisely controlled by appropriate sensors and controllers to ensure that the acquisition time (to rollers and conveyance belt) is exactly uniform and according to the desired timing.

Sheet feeding assemblies used in marking systems are disclosed in U.S. Pat. No. 7,461,839 (Ikeda), and U.S. Pat. No. 7,258,336, the disclosures of these two patents are incorporated by reference into the present disclosure. In U.S. Pat. No. 7,461,839 a sheet-feeding assembly similar to the present invention is disclosed using a suction assembly where the suction openings are closed after contact with the uppermost sheet of the sheet stack; the conveyance belts are driven after the suction-detecting hole is closed according to the negative pressure in the suction duct. A primary distinction from the present invention is that in Ikeda's system the closing of the suction openings by the upper most sheet also causes the cap on the suction-detecting hole to close, while in the present invention the pressure difference between the interior and exterior of the feedhead due to the suction openings being closed creates a force that lifts the cap away and opens the suction-detecting hole. The advantage in the present invention is that by using the pressure difference between the feedhead interior and ambient to open the suction-detecting hole instead of relying on a pressure difference due to a buildup of air flow between the cap and hole to close the suction-detecting hole, it takes much less time than closing the suction-detecting hole which could present a problem in a high speed printing apparatus. Thus, it takes substantially less time to open the suction-detecting hole which is a huge advantage in high speed systems. Also, a further advantage is that the design of the current invention is more straight forward as there is no need to carefully control the distance between the open cap and the suction-detecting hole such, which would be necessary with the prior invention. The feeder of the present invention can equally be used in monochrome or color high speed systems.

In addition, currently, vacuum corrugated feeders operate via open loop control in which actuations or closing of ports of the various mechanisms occur according to a preset timing chart. More specifically, it is expected that the acquisition of a single sheet by the feedhead will occur within a preset period of time after which the feedhead transports the sheet to the take away rolls. If the sheet was not acquired in time, a misfeed will be declared. While it would be advantageous to detect the acquisition of the sheet by the feedhead, the pressure sensor needed to perform this function is relatively expensive.

SUMMARY

This invention provides a simple vacuum level switch to be used inside the feedhead's vacuum plenum to detect when the vacuum level exceeds a predefined threshold. This switch is composed of an opening in the plenum that is covered by a cap which is in turn spring-loaded against the opening. The mechanical properties of the spring are such that the cap is pushed away from the opening by ambient air pressure at the point when the vacuum threshold has been reached during sheet acquisition. A Hall Effect or optical sensor is used to detect this motion and the corresponding signal is sent to the feeder controller. This enables more intelligent control of the feeder while also providing an inexpensive method for tracking sheet acquisition times. A Hall Effect sensor is preferably used for this invention, as it is unaffected by paper dust. A Hall Effect sensor detects the presence of a small magnet embedded in the cap, and switches state when the cap lifts away from the opening.

DETAILED DESCRIPTION OF THE DRAWINGS AND PREFERRED EMBODIMENTS

Figure 1:
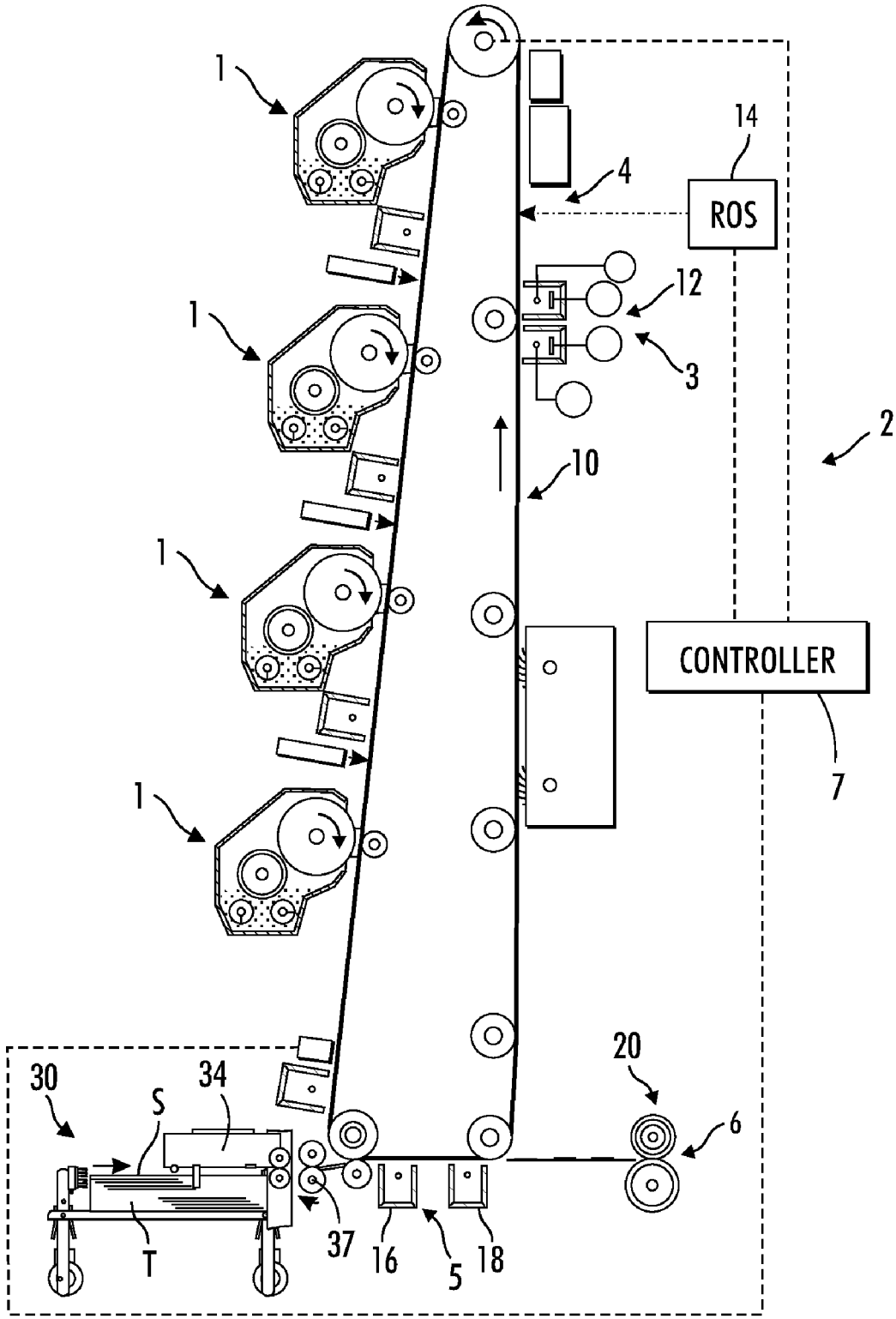
FIG. 1 is a schematic view of an electrophotographic imaging system used to produce color prints and incorporating the vacuum corrugated paper feeder of this invention.

In FIG. 1, a copier or printer 2 is shown using an embodiment of the vacuum corrugation feeder of this invention for removing sheets from a stack and transferring the sheets. In an electrophotographic printing or reproduction machine such as the machine 2 shown in FIG. 1, a photoconductive member or belt 10 is charged by a corona-generating device 12 at a station 3 to a substantially uniform potential so as to sensitize the surface thereof. At an exposure station 4, the charged portion of the photoconductive member 10 is exposed to a light image of an original document being reproduced obtained from a scanning device such as a raster output scanner 14. Exposure of the charged photoconductive member selectively dissipates the charges thereon in the irradiated areas which records an electrostatic latent image on the photoconductive member corresponding to the informational areas contained within the original document.

After the electrostatic latent image is recorded on the photoconductive member, the latent image is developed by bringing a developer material into contact therewith at a series of developer stations 1. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet. For a typical black and white electrophotographic printing machine, a single development station 1 may be provided. With the advent of multicolor electrophotography, multiple additional development stations 1 may be provided that fix color toner to the photoconductive member.

Subsequent to development, a sheet S of paper or support material is moved into contact with the toner images at a transfer station 5. At this station, a transfer dicorotron 16 sprays positive ions onto the backside of the sheet S which attracts the negatively charged toner particle images from the photoreceptor 10 to the sheet S. A detack corotron 18 is provided for facilitating stripping of the sheet S from the surface of the photoreceptor. After transfer, the sheet S travels to a fusing station 6 where a heated fuser roller assembly 20 permanently affixes the toner powder to the sheet S. A high speed sheet feeder such as the feeder 30 of this invention is used for controller timed paper feeding.

Figure 2:
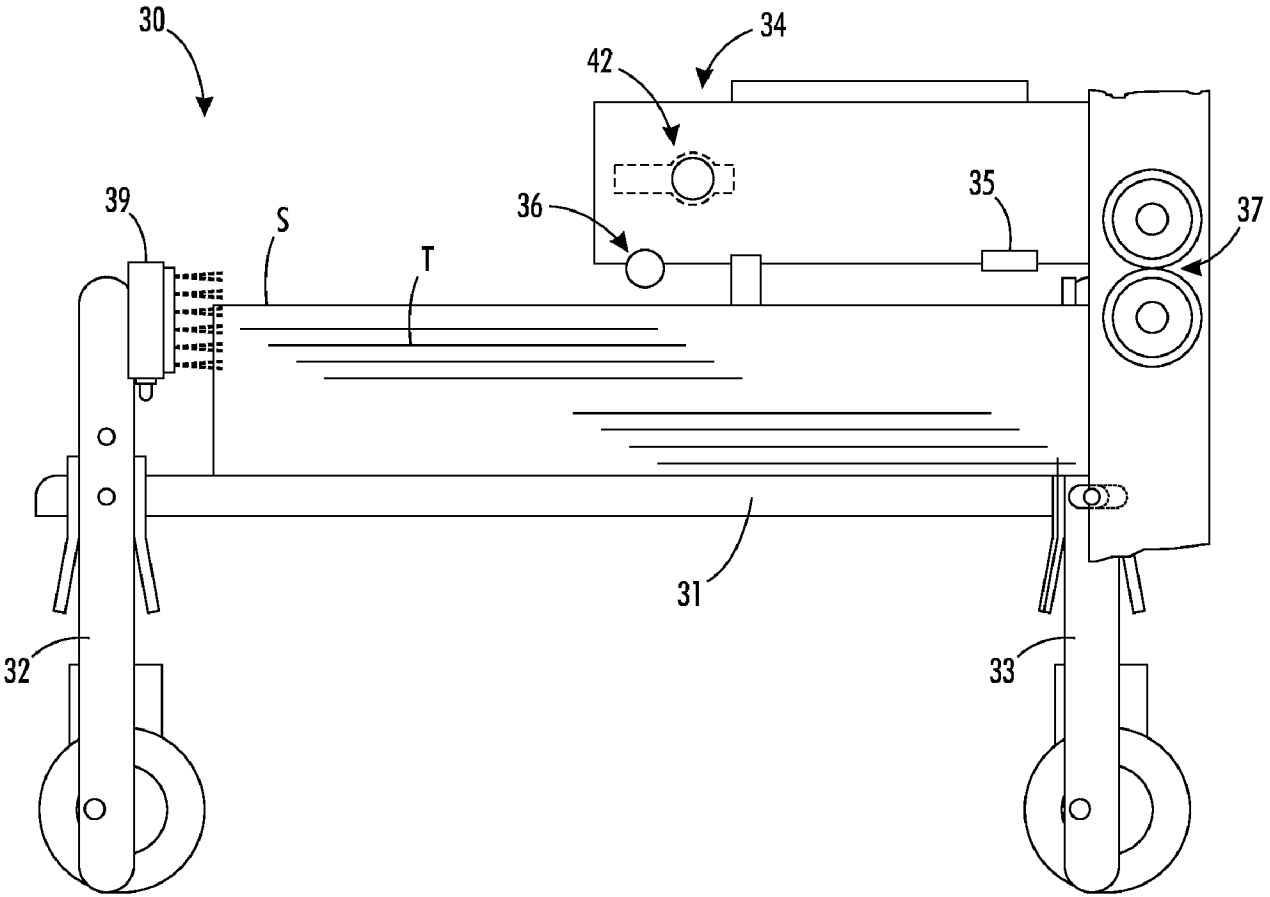
FIG. 2 illustrates a typical sheet feeder used in the imaging system of FIG. 1 and a basic structure of the paper feeder of the present invention.

There is shown in FIG. 2 a side elevational schematic view of a high speed sheet feeder 30 such as that of the present invention. The basic components of the feeder 30 include a sheet support tray 31 which may be tiltable and self-adjusting to accommodate various sheet types and characteristics; multiple tray elevator mechanisms 32 and 33; a vacuum shuttle feedhead 34; a lead edge stack height sensor 35; a stack height sensor 36; a variable acceleration take away roll (TAR) 37; inboard and outboard sheet fluffers 38 and trail edge fluffer 39.

The feedhead 34 is a top vacuum corrugation feeder (VCF). The acquisition surface 40 is the functional surface on the feedhead 34 or vacuum plenum. The two sensors 35 and 36 together enable the paper supply to position the stack T. The stack height sensor 36 contacts the sheet stack T to detect two or more specific sheet positions. This sensor 35 works in conjunction with the second sensor 36 and also controller 7.

Figure 3:
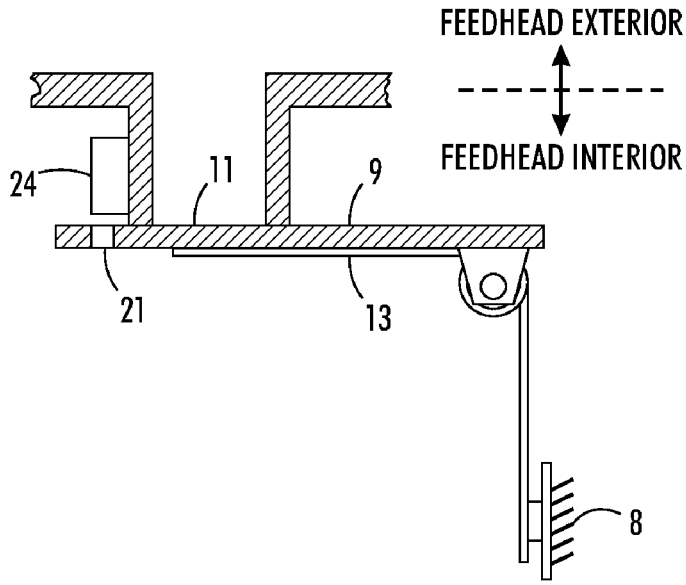
FIG. 3 illustrates an embodiment of the present invention within the feedhead of FIG. 2 where the vacuum port is in the inactive, closed position.
Figure 4:
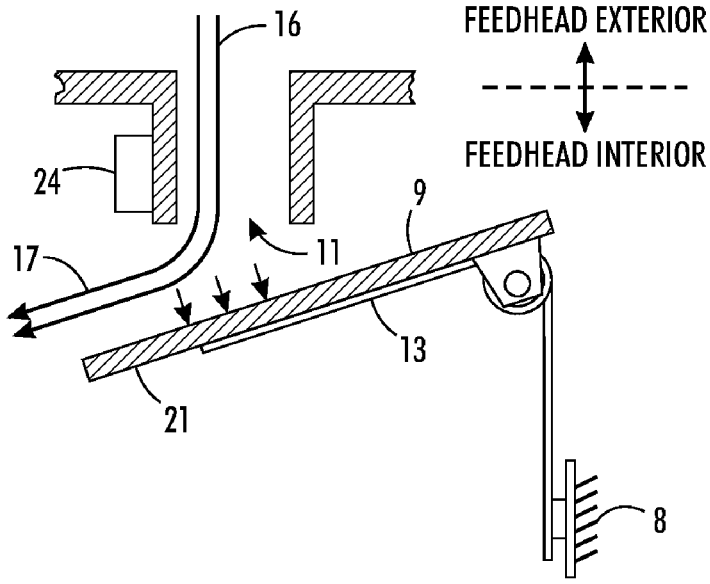
FIG. 4 illustrates an important feature of the present invention where the feedhead creates a force which causes the cap to open and lift off the port.

The paper feeder 30 acquires individual sheets S of paper (using air pressure) from the top of a stack T and transports them forward to the TAR 37 as described in reference to FIGS. 3 and 4. The opening 42 that is used for this invention is located on the feedhead side wall.

FIG. 3 shows one embodiment in which a cap 9 is in the inactive mode held against a port 11 in the wall of the feedhead 34 using a torsion spring 13. Embedded in this cap 9 is a small magnet 21, the presence of which is detected by a Hall Effect sensor 24. The cap 9 is shown in the closed position as would be the case when the feedhead vacuum valve is closed. During feeder operation, a sheet S is acquired to the feedhead after the vacuum valve is opened. Once the sheet S is acquired, the vacuum level within the feedhead 34 rises sharply to its nominal value. The pressure difference between the interior and exterior of the feedhead 34 creates a force which causes the cap 9 to lift off the port 11 (FIG. 4). This in turn moves the magnet 21 away from the Hall Effect sensor 24 which changes the state. This change in state is detected by the feeder controller 7 which can use this information to record the acquisition time and note that the sheet is acquired. As the sheet is released to the take away roll 37, the vacuum valve is closed and the sudden drop in vacuum allows the torsion spring 13 to push the cap 9 back against the port 11. If, for some reason, the Hall Effect switch does not change state within a preset window for sheet acquisition, the feeder controller 7 can either wait until the sheet S is acquired (and skip a pitch if necessary) or simply throw a "misfeed due to late acquisition" fault. A mechanical ground 8 is shown in both FIGS. 3 and 4, which could be readily provided by a feature within the feedhead such as an interior wall. Vacuum air flow 16 is shown by arrows 17.

In FIGS. 3 and 4, the interior components of vacuum feedhead 34 are shown.

As earlier noted, currently, vacuum corrugated feeders operate via open loop control in which actuations of the various mechanisms occur according to a preset timing chart. White it would be advantageous to detect the acquisition of the sheet by the feedhead, the pressure sensor needed to perform this function is relatively expensive. This invention provides a simple vacuum level switch be used inside the feedhead's vacuum plenum to detect when the vacuum level exceeds a predefined threshold. This switch is composed of an opening in the plenum that is covered by a cap which is in turn spring loaded against the opening. The mechanical properties of the spring are such that the cap is pushed away from the opening by ambient air pressure at the point when the vacuum threshold has been reached during sheet acquisition. A Hall Effect or optical sensor is used to detect this motion and the corresponding signal is sent to the feeder controller. This enables more precise and intelligent control of the feeder while also providing an inexpensive method for tracking sheet acquisition times.

In summary, the present invention comprises a novel, electrophotographic marking system and a novel feedhead assembly for use in the system. Provided in this invention is an electrophotographic marking system comprising a paper-feeding station; the paper-feeding station comprising a sensor and a controller.

This vacuum corrugated feeder is for use in a sheet-feeding assembly of a marking system. The feeder comprises a feedhead positioned above a sheet-stacking unit and a feedhead having therein a vacuum source, a vacuum port and a spring. The vacuum port is facing a sheet to be conveyed. A spring-loaded cap is positioned over and covers the vacuum port. The cap 15 is configured to be removed from the vacuum port once a pressure difference between an interior and exterior of the feedhead is reached to effect a change in state. The controller is configured to detect this change in state and thereby permit the sheet to be moved to take-up rollers.

The cap has below it a torsion spring. This spring is configured to bias the cap against the port, thereby maintaining a port closed position. The feedhead is configured to acquire the sheet during a feeder operation after vacuum is applied to the interior of the feedhead. Once the interior vacuum level reaches a predefined threshold, the force induced by the pressure difference between the ambient environment and the feedhead interior causes the cap to lift away from the port. This in turn causes the magnet embedded in the cap to move away from the Hall Effect sensor. The change in state is detected by the sensor and controller which are configured to determine and record thereby an acquisition time to be used to set fixed parameters to be used later by the controller.

The spring is configured to allow the cap to move away from the port when a predefined vacuum level has been reached in the feedhead during sheet acquisition. The feedhead can then transport the acquired sheet to the take-away rolls once the vacuum port is opened. The feedhead of this invention is usable in a paper-handling assembly. The feedhead comprises a sensor, a controller and a housing having an interior portion in communication with the controller. The controller is configured to activate various components within the housing according to preset timing.

The housing is positioned above a sheet-stacking unit and comprises a vacuum component configured to generate a change in pressure within the housing. The housing comprises a vacuum port that is covered by an air-blocking cap. The cap is spring loaded against the vacuum port. The air-blocking cap is configured to be moved away from the vacuum port when a vacuum threshold has been reached within the housing during a sheet acquisition operation.

The cap is in movable contact with a torsion spring. This spring is configured to allow the cap to move off the port when a difference between ambient air pressure and a vacuum threshold are reached within the housing. A sensor is positioned above the cap. This sensor is configured to detect motion of the cap and is configured to communicate this information to the controller.

The sensor is a Hall Effect or optical sensor and is configured to sense a vacuum level within the feedhead and detect when the vacuum level exceeds a predefined threshold. The sensor is in communication with the controller. The controller is configured to control activity within the feedhead according to a preset timing.

The feedhead is configured to suction a paper sheet by utilizing vacuum-generated pressure and to convey the paper sheet to take-up rollers. The cap is configured such that it covers the vacuum port when a sudden drop in vacuum occurs that allows the torsion spring to push the cap back against the port. The cap has positioned horizontally below it an upper portion of the torsion spring. This upper portion is connected to a lower vertical spring portion. Located between and connecting the upper portion and the lower vertical spring portion is a spring fulcrum. The torsion spring is configured to bend or move at the fulcrum when movement of the cap is effectuated.

A magnet is positioned in the cap at a location in magnetic communication with the Hall Effect sensor. The sensor is positioned above the cap and configured to detect cap motion. The sensor is configured to communicate the presence of the motion to the controller.

It will be appreciated that variations of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. An electrophotographic marking system comprising a paper-feeding station, said paper-feeding station comprising:

a sensor and a controller, a vacuum corrugated feeder for use in a sheet-feeding assembly of said marking system, said feeder comprising a feedhead positioned above a sheet-stacking unit and said feedhead having therein a vacuum source and a vacuum port and a spring, said vacuum port facing an ambient environment, a spring-loaded cap positioned over and covering said vacuum port, said cap configured to be removed from said vacuum port once a pressure difference between an interior and exterior of said feedhead is reached to effect a change in state and the pressure difference between the interior and exterior of the feedhead due to the vacuum port being closed creates a force that lifts the cap away and opens the vacuum port, said controller configured to detect said change in state and thereby permit said sheet to be moved to take-away rollers, wherein said change in state is detected by said sensor and controller which are configured to determine and record thereby an acquisition time to be used to set fixed parameters to be used by said controller.

2. The marking system of claim 1 wherein said cap having below it a torsion spring, said spring configured to allow said cap to move to a port opening position.

3. The marking system of claim 1 wherein said feedhead is configured to transport said sheet to the take-away rollers during a feeder operation after said vacuum port is opened.

4. The marking system of claim 1 wherein said spring is configured to allow said cap to be pushed away from said port when a predefined difference between feedhead vacuum and ambient air pressure has been reached during sheet acquisition.

5. The marking system of claim 1 wherein said take-away rollers are activated to acquire said sheet once said vacuum port is opened.

6. A feedhead usable in a paper-handling assembly, said feedhead comprising:

a sensor and controller, a housing having an interior portion in communication with a controller, said controller configured to activate various components within said housing according to preset timing, said housing positioned above a sheet stacking unit and comprising vacuum component configured to generate a change in pressure within said housing, said housing comprising a vacuum port that is covered by an air-blocking cap, said cap being spring-loaded against said vacuum port, said air-blocking cap configured to be moved away from said vacuum port when a vacuum threshold has been reached within said housing during a sheet acquisition operation and a pressure difference between an interior and an exterior of the feedhead due to the vacuum port being closed creates a force that lifts the cap away and opens the vacuum port, wherein said change in state is detected by said sensor and controller which are configured to determine and record thereby an acquisition time to be used to set fixed parameters to be used by said controller.

7. The feedhead of claim 6 wherein said cap is in movable contact with a torsion spring, said spring configured to allow said cap to move off said port when ambient air pressure and a vacuum threshold is reached within said housing.

8. The feedhead of claim 6 wherein a sensor is positioned above said cap, said sensor configured to detect motion of said cap and configured to communicate this information to said controller.

9. The feedhead of claim 6 wherein said sensor is a Hall Effect or optical sensor and is configured to sense a vacuum level within said feedhead and detect when said vacuum level exceeds a predefined threshold, said sensor in communication with said controller, said controller configured to control activity within said feedhead according to a preset timing.

10. The feedhead of claim 6 configured to suction a paper sheet by utilizing vacuum-generated pressure and to convey said paper sheet to take-away rollers.

11. The feedhead of claim 6 wherein said cap is configured when said cap is located away from said vacuum port and a sudden drop in vacuum occurs, allowing said torsion spring to push said cap back against said port.

12. The feedhead of claim 9 wherein said sensor is a Hall Effect sensor and a magnet is positioned in said cap at a location in magnetic communication with said Hall Effect sensor.

13. The feedhead of claim 6 wherein said sensor is configured to detect cap motion and to communicate the presence of said motion to said controller.

* * * * *